US011464288B1

(12) United States Patent
Baker

(10) Patent No.: US 11,464,288 B1
(45) Date of Patent: Oct. 11, 2022

(54) ADJUSTABLE SUSPENSION SHOE

(71) Applicant: Scott Baker, Sherman Oaks, CA (US)

(72) Inventor: Scott Baker, Sherman Oaks, CA (US)

( * ) Notice: Subject to any disclaimer, the term of this patent is extended or adjusted under 35 U.S.C. 154(b) by 82 days.

(21) Appl. No.: 17/035,639

(22) Filed: Sep. 28, 2020

(51) Int. Cl.

| | |
|---|---|
| ***A43B 21/30*** | (2006.01) |
| ***A43B 13/18*** | (2006.01) |
| ***A43B 21/32*** | (2006.01) |
| *A43B 7/38* | (2006.01) |

(52) U.S. Cl.
CPC ..... *A43B 21/30* (2013.01); *A43B 13/182* (2013.01); *A43B 13/184* (2013.01); *A43B 21/32* (2013.01); *A43B 7/38* (2013.01)

(58) Field of Classification Search
CPC ..... A43B 13/181–184; A43B 21/26; A43B 21/30; A43B 21/32; A43B 21/36; A43B 21/47
See application file for complete search history.

(56) References Cited

U.S. PATENT DOCUMENTS

| | | | | | |
|---|---|---|---|---|---|
| 458,010 | A * | 8/1891 | Beach | A43B 21/30 | 36/38 |
| 631,683 | A * | 8/1899 | Swan | A43B 21/30 | 36/38 |
| 1,127,456 | A * | 2/1915 | Kurz | A43B 21/30 | 36/38 |
| 2,257,482 | A * | 9/1941 | Resko | A43B 21/30 | 36/38 |
| 2,464,251 | A * | 3/1949 | Moody | A43B 21/26 | 36/35 B |
| 2,508,318 | A * | 5/1950 | Wallach | A43B 21/30 | 36/38 |
| 2,535,102 | A * | 12/1950 | De Werth | A43B 21/30 | 36/38 |
| 2,669,038 | A * | 2/1954 | De Werth | A43B 21/30 | 36/38 |
| 2,825,154 | A * | 3/1958 | Windle | A43B 13/12 | 36/38 |
| 3,886,674 | A * | 6/1975 | Pavia | A43B 21/30 | 36/38 |
| 6,393,731 | B1 * | 5/2002 | Moua | A43B 13/182 | 36/35 B |
| 8,220,185 | B2 * | 7/2012 | Baker | A43C 15/161 | 36/35 R |
| 8,365,439 | B2 * | 2/2013 | Koh | A43B 21/54 | 36/35 R |
| 9,538,809 | B2 * | 1/2017 | Park | A43B 13/182 | |
| 2005/0081401 | A1 * | 4/2005 | Singleton | A43B 7/14 | 36/27 |
| 2011/0225842 | A1 * | 9/2011 | Lu | A43B 21/38 | 36/35 R |
| 2015/0075032 | A1 * | 3/2015 | Skrepenski | A43B 21/437 | 36/100 |

* cited by examiner

*Primary Examiner* — Ted Kavanaugh

(57) ABSTRACT

A spring compression system for shoes that functions much like a car's suspension in absorbing the shock and impact that occurs when shoes contact the ground. Wherein form is the most important element of shoes and function is a distant afterthought, the ergonomically poor design of shoes desperately require the healthier environment for the wearer a spring compression system would offer with the additional ability to be adjusted to suit the weight of the wearer as well as the level of shock absorption desired.

5 Claims, 21 Drawing Sheets

ADJUSTABLE SUSPENSION SHOE

CROSS-REFERENCE TO RELATED APPLICATIONS

This application claims the benefit of U.S. Provisional Patent Application Ser. No. 62/91,829 filed Oct. 4, 2019, the contents of which are incorporated by reference in their entirety.

FIELD AND BACKGROUND OF THE INVENTION

As shoes have evolved over the centuries our feet and bodies have been impacted in many ways, from the form of the shoe changing our actual skeletal foot structure to the change in angle between the ground and the bottom of the shoe itself. The physical impact of the body weight on the foot as it is positioned in the shoe has increased over time as well and while some shoes have incorporated different types of cushioning the severity of some shoes pushing the limits of angle in relation to the ground and form has created a boom in chronic back pain. High heels being the most egregious predator.

The higher the heel the more forward leaning the body wants to lean for "correct" position, of course that correct position would have the person falling over so that must be corrected somewhere in the spine to create a vertical standing position, at to that the fact that in a high heel the bones of the foot are forced to carry weight at angles and loads they are not indented to, add to that the pounding force delivered with each and every step.

The aforementioned issues when combined creates an environment that desperately needs cushioning best described as suspension, something that can almost neutralize the impact on the foot and thus, the body when walking in modern shoes of several types.

SUMMARY OF THE INVENTION

Much like vehicles today have height and ride adjustable suspension designed to give the driver the type of "feel" when driving, whether that be a stiff ride or a smooth ride, this invention delivers that very option to shoes or all types and styles.

In one embodiment of the invention is a typical high heel shoe that incorporates an internal spring compression system in the heel itself that not only allows for changing of the spring for differing body weights, it also allows for incremental adjustments to the preload to give the wearer the exact amount of cushion compression they desire.

In one embodiment of the invention the front forward part of the shoe that contacts the ground incorporates an internal spring compression system in the sole area itself that not only allows for changing of the spring for differing body weights it also allows for incremental adjustments to the preload to give the wearer the exact amount of cushion compression they desire.

In one embodiment both the heel area and the frontal contact area incorporate an internal spring compression system that not only allows for changing of the spring for differing body weights it also allows for incremental adjustments to the preload to give the wearer the exact amount of cushion compression they desire.

In one embodiment the shoe is a high heel which in addition to the internal spring compression system has an internally tensioned "walking foot" assembly at the base of the heel itself. The design of the high heel presents only a thin edge of heel pad material making initial contact with the ground with each new forward step, as the body moves over the shoe the small edge contacting the ground becomes the entirety of the heel pad contacting the ground. With the majority of high heels having a very small heel pad the initial contact with the ground creates a less than safe grip. With the "walking foot" element, as soon as the heel pad makes contact with the ground the heel pad itself in its entirety pivots immediately so the entire pad is contacting the ground at initial contact, adding stability in general as well as producing a solid foundation for the spring compression system to function.

The walking foot assembly can also be incorporated into any type or style of shoe as can the internal spring compression system.

DETAILED DESCRIPTION OF THE DRAWINGS

Figure 1:
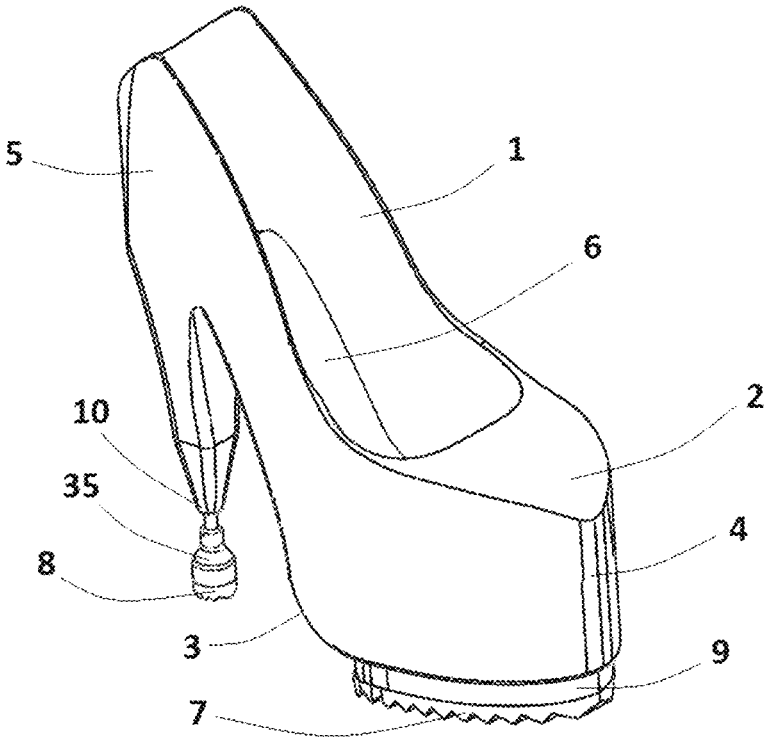
FIG. 1 Shown in ¾ front view, a high heel shoe with moveable sole components.

FIG. 1 A shoe 1 detailing a high heel style in ¾ top front view with a top portion 2 bottom or sole portion 3 a front end toe portion 4 a rear heel portion 5 with the shoe heel bottom edge 10, an interior portion 6 for accepting a foot, a front area contact pad 7 and a rear heel contact pad 8, a moveable inner front sole component 9 and a moveable heel component 35.

Figure 2:
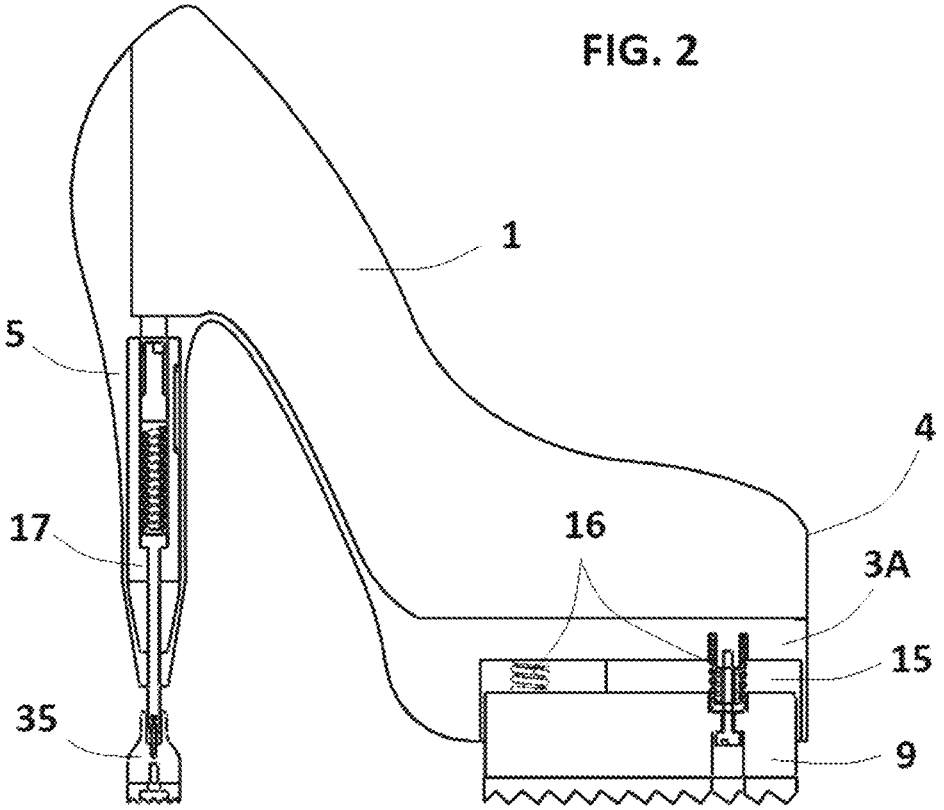
FIG. 2 In side view and cut-away format, a high heel displaying an internal suspension system in the front sole and heel portions of a shoe.

FIG. 2 A shoe 1 detailing a high heel style in side view and in cut-away format showing the thickness of the sole 3A at the front end toe portion 4 which houses an internal cavity area 15 for which the front moveable inner sole component 9 moves up into under compression from weight distributed in the walking process, springs 16 in several locations carry the loads and direct and align the moveable inner sole component in the internal cavity 15. Heel area 5 showing an overview of internal compression cylinder 17 and moveable heel sole component 35.

Figure 3:
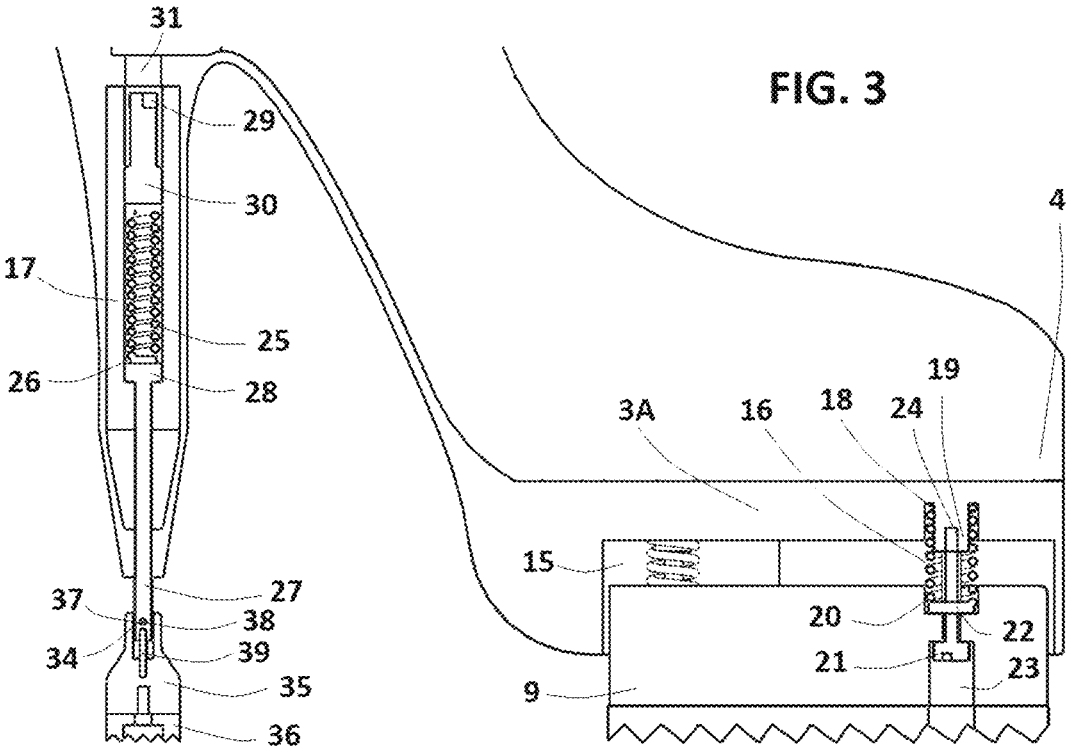
FIG. 3 A close up version of FIG. 2

FIG. 3 A shoe 1 detailing a high heel style in side view and in cut-away format showing the thickness of the sole 3A at the front end toe portion 4 which houses an internal cavity area 15 for which the front moveable inner sole component 9 moves up into under compression from weight distributed in the walking process, springs 16 reside on one end in recess 18 and register internally on spring perch 19, the other end of the spring 16 residing in front moveable inner sole component 9 recess 20 and contacting spring spacer contact 22 of the tension adjustment screw 21 which is accessible through access relief 23 and has a threaded end 24 which threads into spring perch 19 allowing for adjusting the amount of travel length the spring 16 has which directly affects the amount of impact buffering the spring 16 can offer. Compression cylinder 17 housing a compression spring 25 in its internal cavity 26, spring 25 on one end contacting shoulder 28 of the compression post 27 while its other end contacts the shoulder 30 of the tension adjustment screw 29. Adjustment screw 29 accessible for adjustment through access portal 31 located in the inner portion 6 of the shoe 1. Compression post 27 having a non-shouldered end with a pivot pin hole 34 which uses pivot pin 38 to attach heel foot component 35 to compression post 27 as well as a slot 32, heel foot component 35 having a foot pad 36 a recess 37 for the compression post 27 and a slot 33 in the recess 37 for the tension blade 39, tension blade 39 keeping the heel foot component 35 in the same horizontal plane as the moveable inner sole component 9 and front contact pad 7 while offering significant resistance to allowing the heel foot component to bend or "walk" when downward pressure is applied and then return the heel foot component to its horizontal plane when such pressure is removed.

Figure 4:
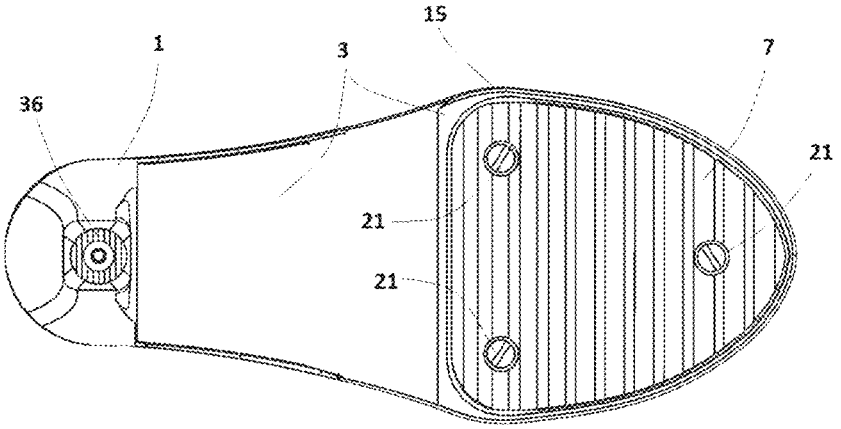
FIG. 4 Bottom view of a high heel style shoe.

FIG. 4 Showing the bottom view of a high heel style shoe 1 detailing the sole 3 the heel foot component 36 the frontal contact to ground pad 7 the inner cavity 15 that allows the moveable inner front sole component space, and the multiple of tension adjustment screws 21 that allow the wearer to adjust the amount of cushion is afforded the shoe when walking and applying downward impacting pressure.

Figure 5:
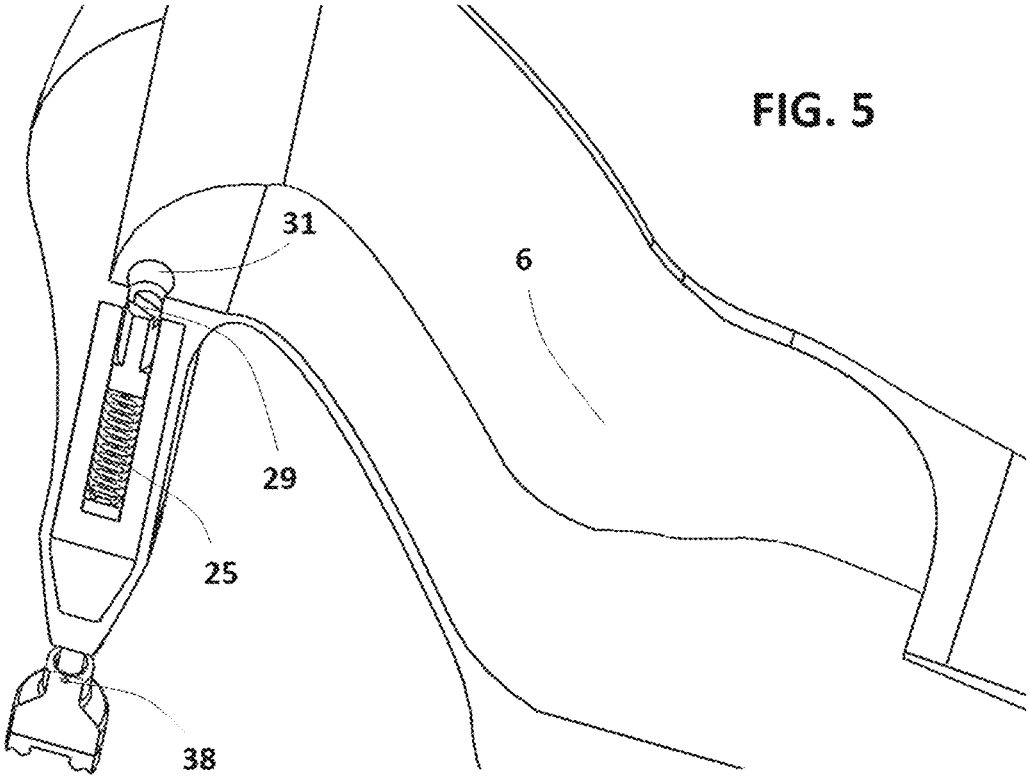
FIG. 5 A high heel style shoe, in top side view and in cut-away format, the inner workings of the internal suspension of the heel.

FIG. 5 A high heel style shoe 1 shown in cut-away format at a side top view revealing the inner area 6 with the heel tension adjustment screw 29 access portal 31 shown as well as the pivot pin 38 and the spring 25.

Figure 6:
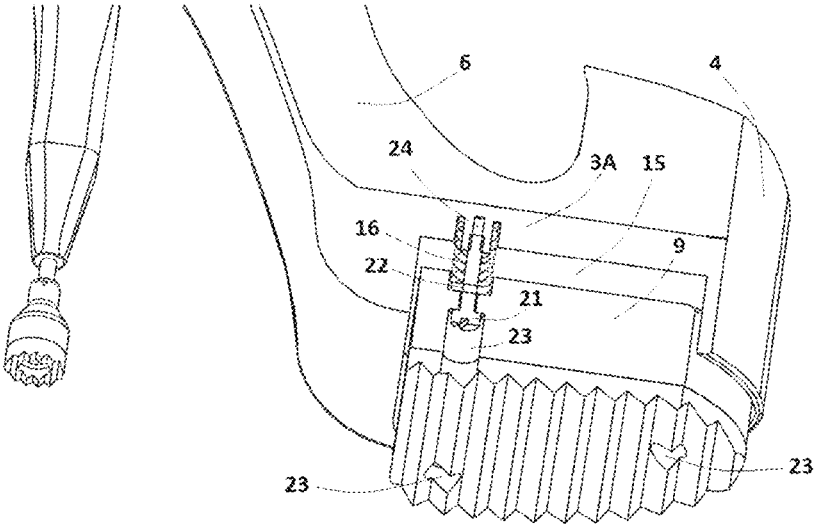
FIG. 6 A high heel style shoe, in bottom side view and in cut-away format, the inner workings of the internal suspension of the front sole area.

FIG. 6 A high heel style shoe in cut-away and side bottom view revealing the inner compartment 6 for receiving a foot, the thickness of the sole 3A and the front toe 4 contact area with the moveable inner sole component 9 placed in the cavity 15 for receiving said part, the spring compression system as detailed in FIG. 3 descriptions as well as the multiple placements of the front contact pad springs tension adjustment screws access portals 23.

Figure 7:
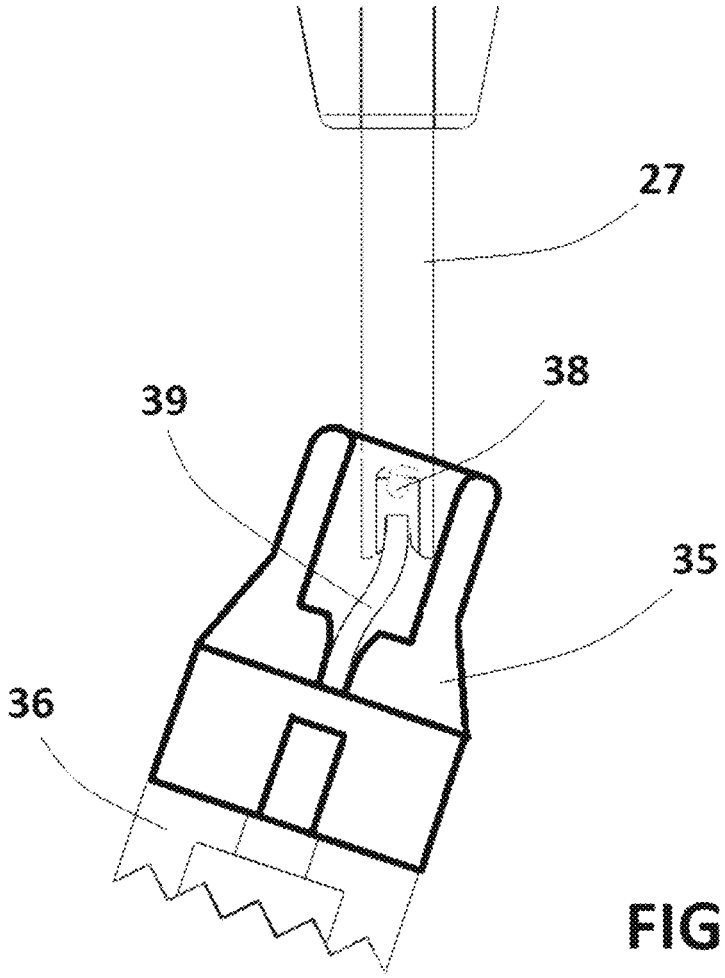
FIG. 7 Close up side view and in cut-away format, the "walking foot" is detailed.

FIG. 7 Shows a side view in cut-away format of the heel foot component 35 detailing the maximum movement capability of the heel foot 35. The tension blade 39 is shown as it relates to the compression post 27 and heel foot 35 when the heel foot pivots under the load of the wearer in motion. The tension blade 39 is of a material that always retains its original shape thus offering resistance to pressure that is measurable and consistent.

Figure 8:
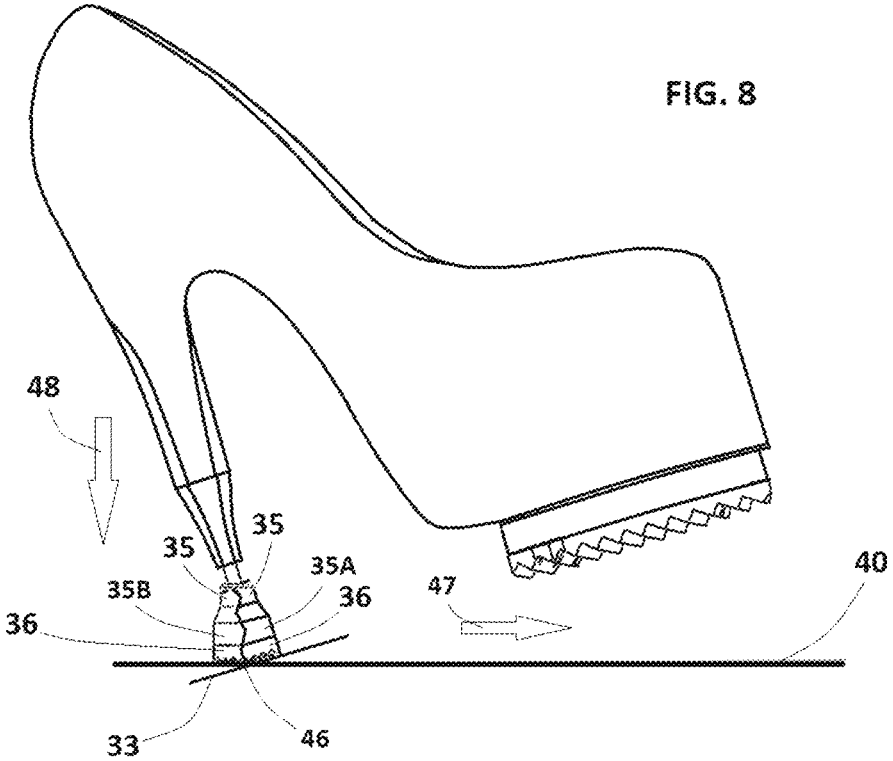
FIG. 8 Side view of a high heel style shoe showing the walking foot heel pad shifting from initial contact on ground to full contact as shoe begins movement towards the ground.

FIG. 8 A shoe in side view and in a mid-step position with the heel foot pad 36 having just made contact 46 on its rear most edge, the forward and downward motion (arrows 47 & 48) and pressure causing the heel foot 35 to pivot from its normal resting position 35A wherein only the edge of the pad would make contact until the sole of the sole made full contact with the ground 40, to its pivoted position 35B wherein the entirety of the heel foot pad immediately makes full contact due to the forward and downward pressure of the shoe as it makes initial contact on the ground creating a much more stabile environment for the wearer. The degree between 33 and 40 clarify the distance the shoe actually has to travel once initial ground contact is made before a full and secure contact is established.

Figure 9:
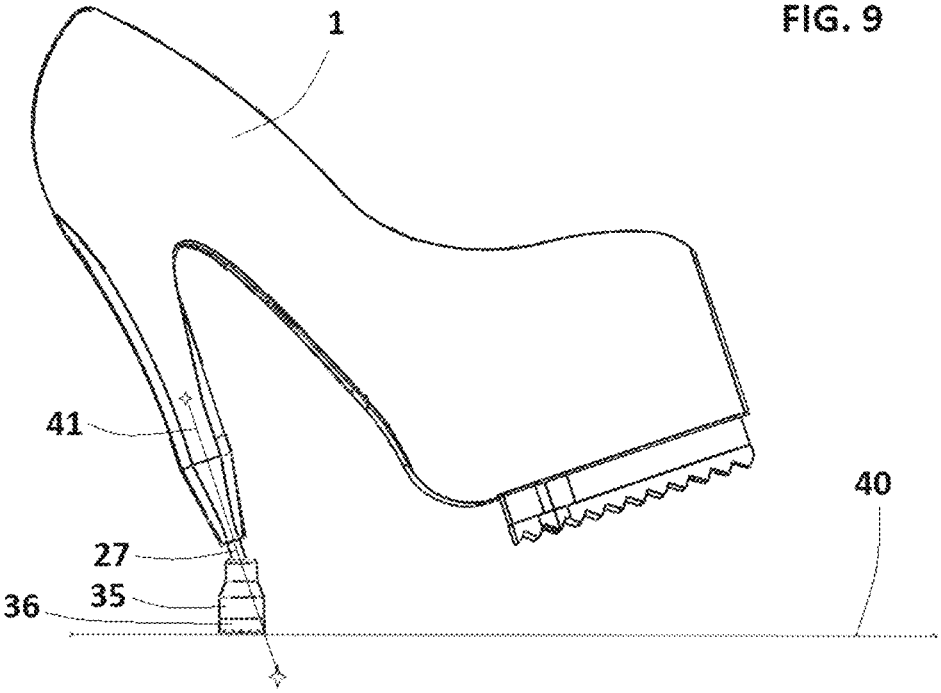
FIG. 9 Side view of a high heel style shoe showing the walking foot heel pad having fully shifted from initial contact on ground to full contact as shoe begins movement towards the ground.

FIG. 9 A shoe in side view and in a mid-step position with the heel foot pad 36 having just made contact with the ground 40 and the heel foot 35 has pivoted immediately so the heel foot pad 36 has full contact with the ground creating a secure and stabile environment for the wearer. Angled line 41 details the pressure line into the ground while the heel has full contact and the motion of the shoe on the wearer pivots forward over the heel foot pad 36 while the pad 36 retains 100% contact with the ground 40.

Figure 10:
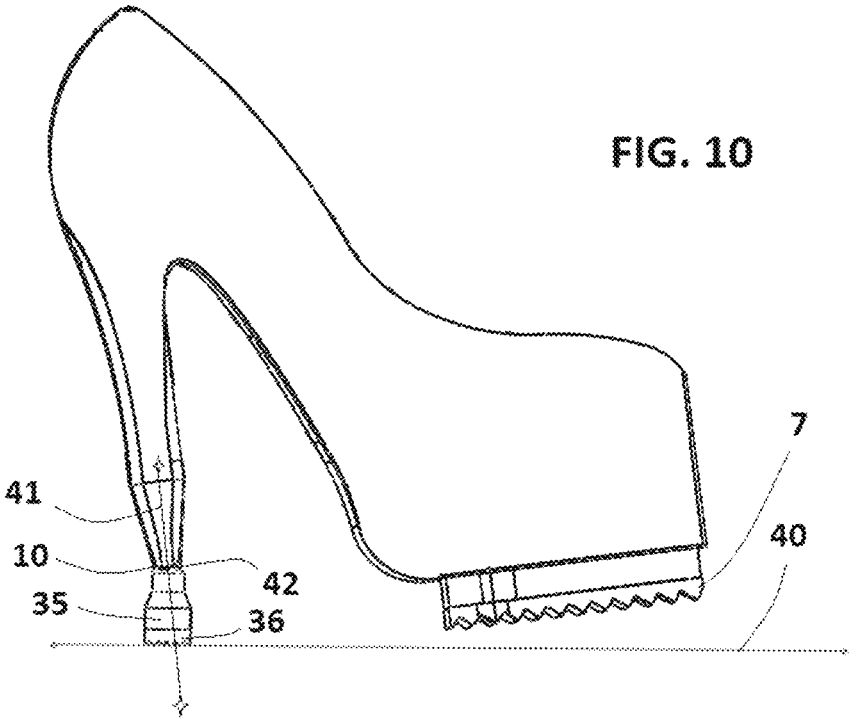
FIG. 10 Side view of a high heel style shoe showing the walking foot heel pad fully contacting the ground and the suspension component in the heel compressed to buffer the impact as the shoe continues forward and the front portion of the sole moves closer to the ground.

FIG. 10 Similar to FIG. 9, this figure shows the same shoe further along in its motion to having full contact with the ground as noted by the angle of line 41, as the motion continues forward the load from the wearer after the heel foot pad 36 makes contact with heel itself activates the internal compression spring system. Full heel compression is indicated at point 42 where the shoe heel bottom edge 10 of the shoe is shown to almost contact the upper edge of the heel foot component 35, also shown is the front contact pad 7 of the shoe being markedly closer to the ground 40.

Figure 11:
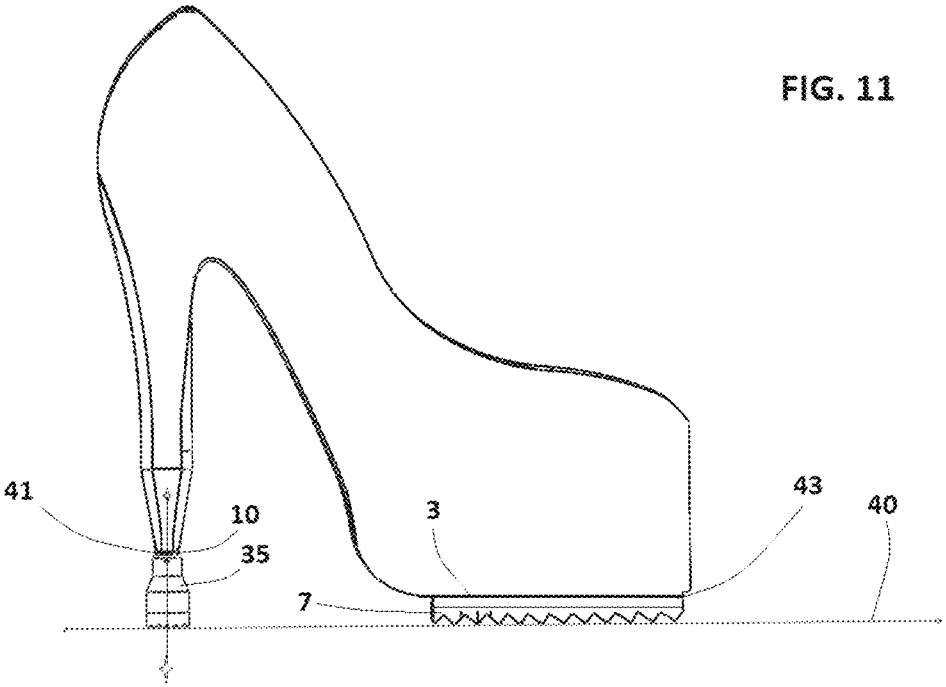
FIG. 11 Side view of a high heel style shoe showing the walking foot heel pad fully contacting the ground and the suspension component in the heel compressed to buffer the impact as the front portion of the sole makes contact with the ground and is shown in compression.

FIG. 11 A high heel style shoe shown in side view in a position of a completed full step, the body of the wearer has their weight and pressure directly over the shoe and thus both the heel spring compression system and the front sole portion spring compression system are fully activated and have absorbed and cushioned the impact of shoe and thus foot to the ground. The heel compression as indicated by point 42 showing the bottom edge of the heel 10 to heel foot component 35 closeness and the front sole compression as indicated by point 43 showing the closeness of the front contact pad 7 to the sole 3.

Figure 12:
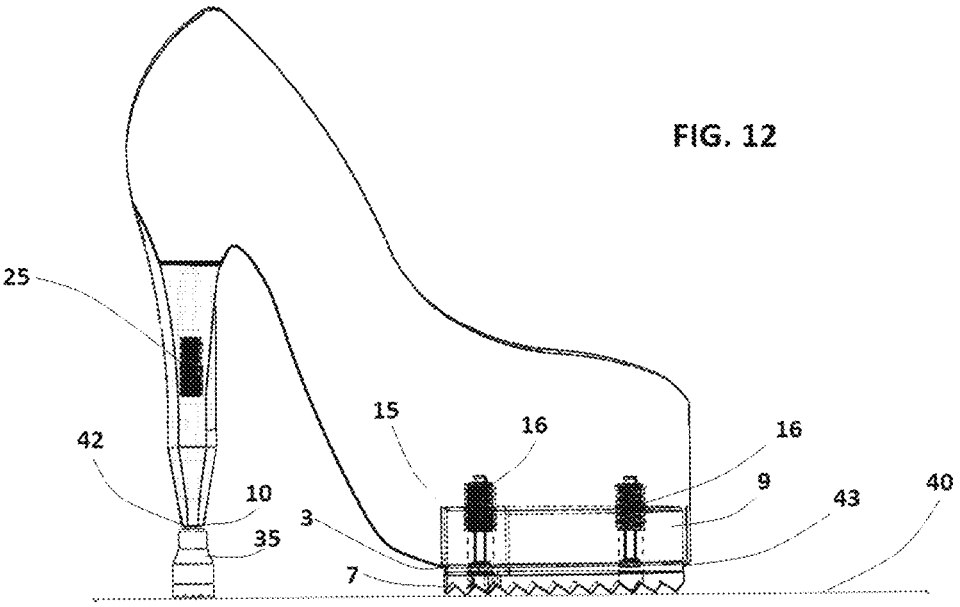
FIG. 12 Side view of a high heel style shoe shown in transparent format detailing the internal suspension components in full compression as the wearers full weight transitions across the top of the shoe in the walking process.

FIG. 12 Transparent view of FIG. 11 showing heel spring 25 in their compressed state and front moveable pad springs 16 in their compressed state.

Figure 13:
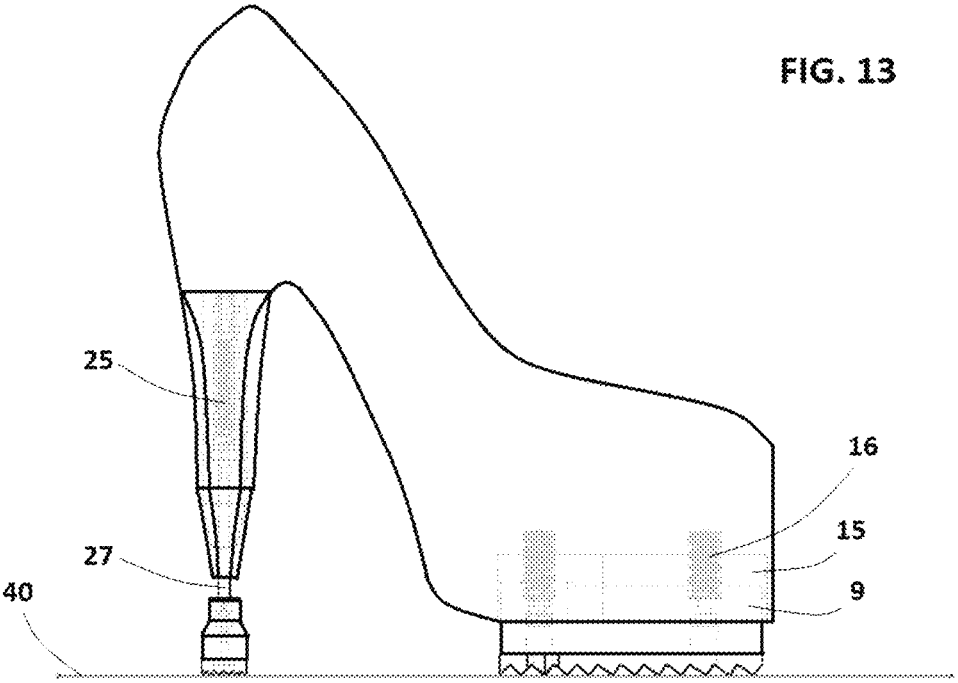
FIG. 13 Side view of a high heel style shoe shown in transparent format detailing the internal suspension components in full expanded resting position as when not being worn or carrying weight.

FIG. 13 Transparent side view of a high heel style shoe with the compression system in its relaxed expanded state. The compression springs 25 and 16 are at their full length.

Figure 14:
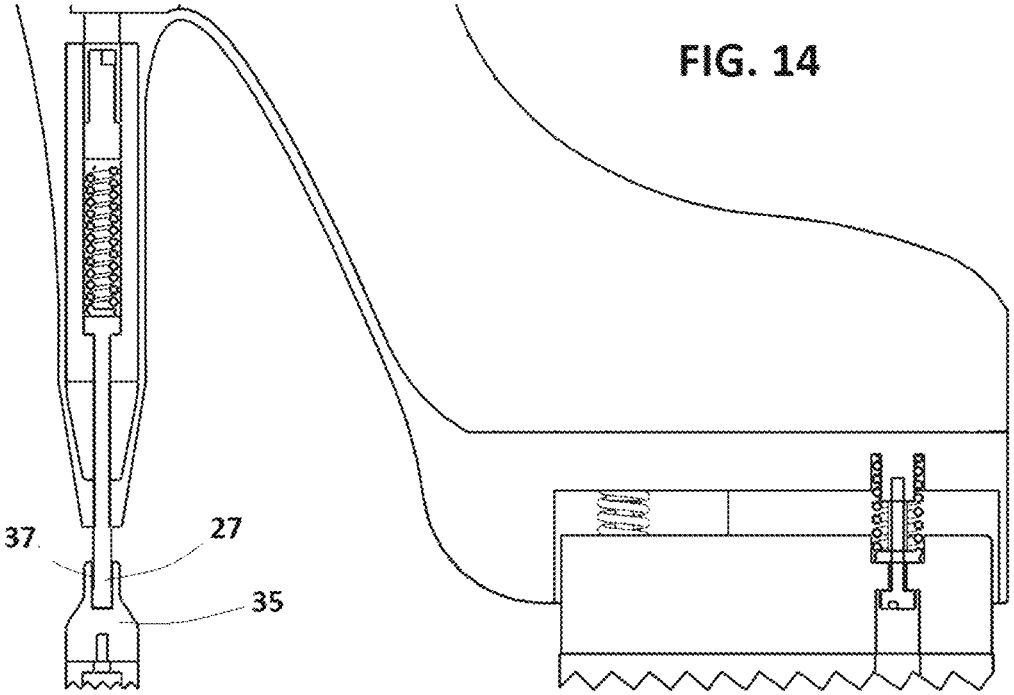
FIG. 14 Side view of a high heel style shoe shown in cut-away format showing another embodiment wherein the heel pad of the heel itself does not having a "walking foot" pad.

FIG. 14 Side view in cut-away format a high heel style shoe with a front and rear spring compression system, the heel foot component 35 being mounted solid and rigid to the compression post 27.

Figure 15:
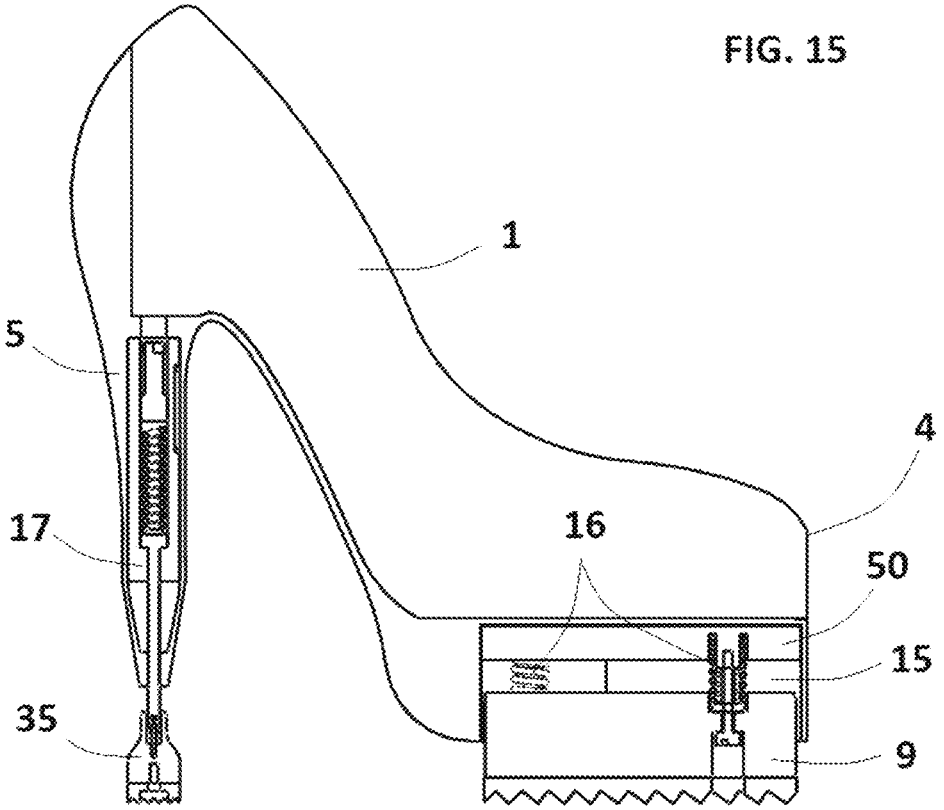
FIG. 15 Side view of a shoe similar to FIG. 2, this embodiment detailing a self-contained front of the sole area compression system that resides in a recess cavity located in the sole.

FIG. 15 A shoe 1 detailing a high heel style in side view and in cut-away format showing an internal cavity area 15 for which the self-contained front moveable inner sole compression system including moveable component 9, base mounting plate 50, springs 16, and tension adjustment screws 21 absorb impact under compression from weight distributed in the walking process, springs 16 in several locations carry the loads and direct and align the moveable inner sole component in the internal cavity 15. Heel area 5 showing an overview of internal compression cylinder 17 and moveable heel sole component 35.

Figure 16:
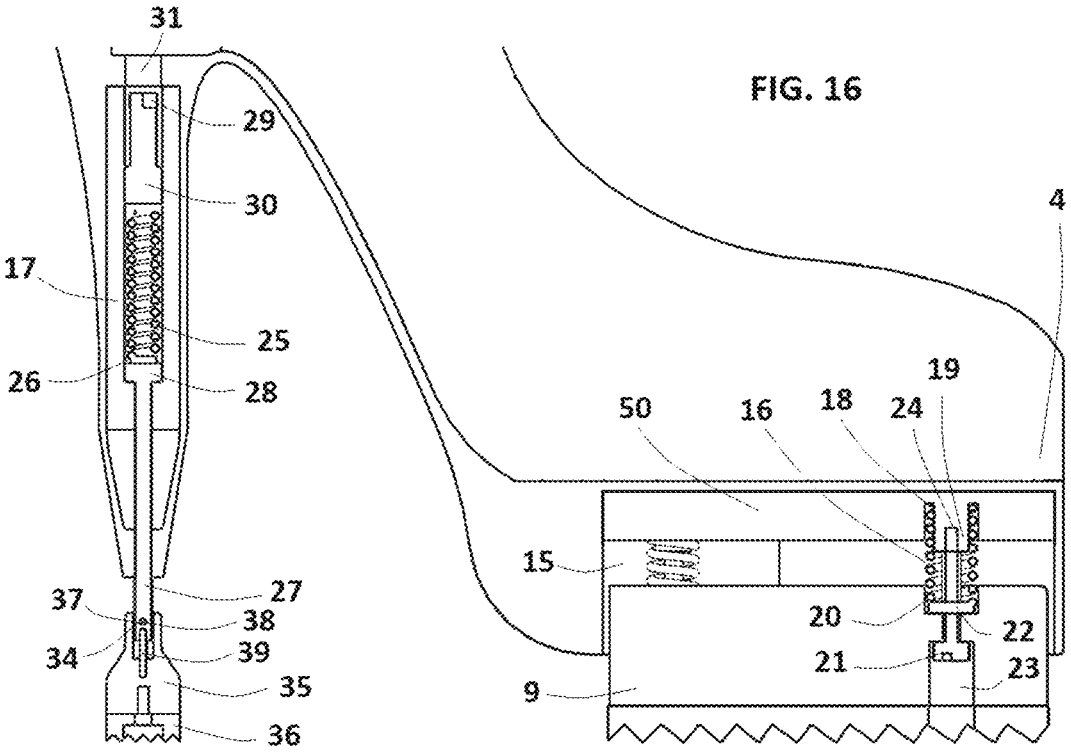
FIG. 16 A close up view of FIG. 15

FIG. 16 A shoe 1 detailing a high heel style in side view and in cut-away format showing an internal cavity area 15 for which the self-contained front moveable inner sole compression system including moveable component 9, base mounting plate 50, springs 16, and tension adjustment screws 21 absorb impact under compression from weight distributed in the walking process, one end of springs 16 reside in recess 18 and register internally on spring perch 19 located on base mounting plate 50, the other end of the spring 16 residing in front moveable inner sole component 9 recess 20 and contacting spring spacer contact 22 of the tension adjustment screw 21 which is accessible through access relief 23 and has a threaded end 24 which threads into spring perch 19 allowing for adjusting the amount of travel length the spring 16 has which directly affects the amount of impact buffering the spring 16 can offer. Compression cylinder housing 17 containing a compression spring 25 in its internal cavity 26, spring 25 on one end contacting shoulder 28 of the compression post 27 while its other end contacts the shoulder 30 of the tension adjustment screw 29. Adjustment screw 29 accessible for adjustment through access portal 31 located in the inner portion 6 of the shoe 1. Compression post 27 having a non-shouldered end with a pivot pin hole 34 which uses pivot pin 38 to attach heel foot component 35 to compression post 27 as well as a slot 32, heel foot component 35 having a foot pad 36 a recess 37 for the compression post 27 and a slot 33 in the recess 37 for the tension blade 39, tension blade 39 keeping the heel foot component 35 in the same horizontal plane as the moveable inner sole component 9 and front contact pad 7 while offering significant resistance to allowing the heel foot component to bend or "walk" when downward pressure is applied and then return the heel foot component to its horizontal plane when such pressure is removed.

Figure 17:
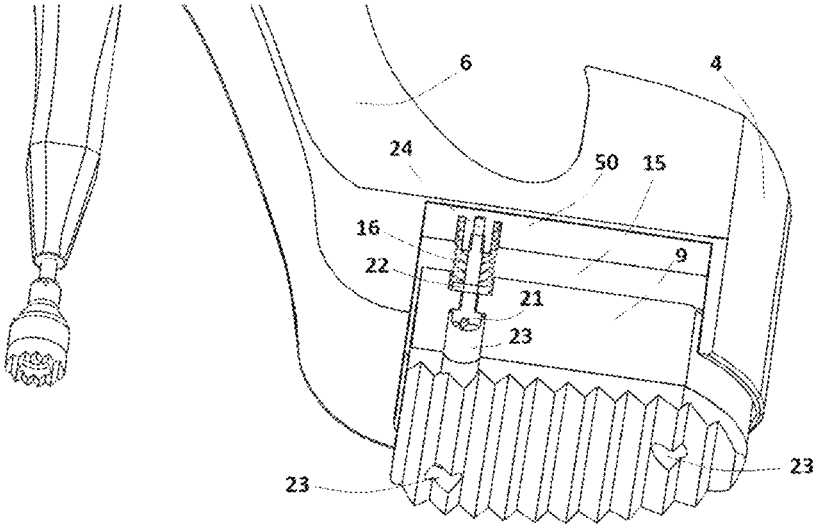
FIG. 17 A cut-away bottom side view of a shoe, detailing the same embodiment as FIGS. 15 & 16
Figure 18:
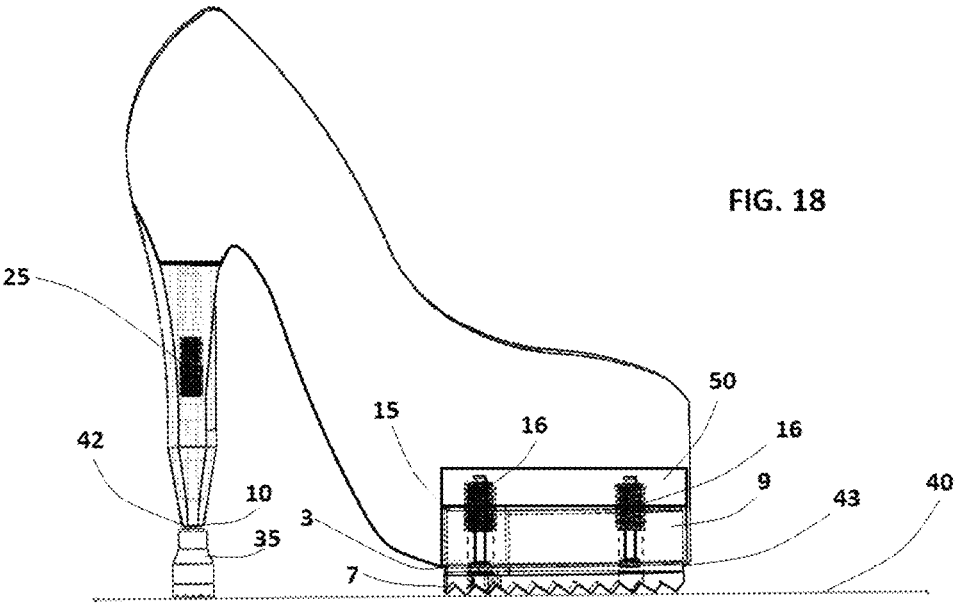
FIG. 18 Side view of a shoe in transparent format similar to FIG. 12, this embodiment detailing a self-contained front of the sole area compression system that resides in a recess cavity located in the sole, and the heel compression system detailing both systems in an active compressed state.

FIG. 17 A high heel style shoe in cut-away and side bottom view revealing the inner compartment 6 for receiving a foot, a self-contained front moveable inner sole compression system including moveable component 9, base mounting plate 50, springs 16, and tension adjustment screws 21 absorb impact under compression from weight distributed in the walking process, one end of springs 16 reside in recess 18 and register internally on spring perch 19 located on base mounting plate 50, the other end of the spring 16 residing in front moveable inner sole component 9 recess 20 and contacting spring spacer contact 22 of the tension adjustment screw 21 which is accessible through access relief 23 and has a threaded end 24 which threads into spring perch 19 allowing for adjusting the amount of travel length the spring 16 has which directly affects the amount of impact buffering the spring 16 can offer. FIG. 18 Transparent view of FIG. 16 showing heel spring 25 in a compressed state and front springs 16 in a compressed state.

Figure 19:
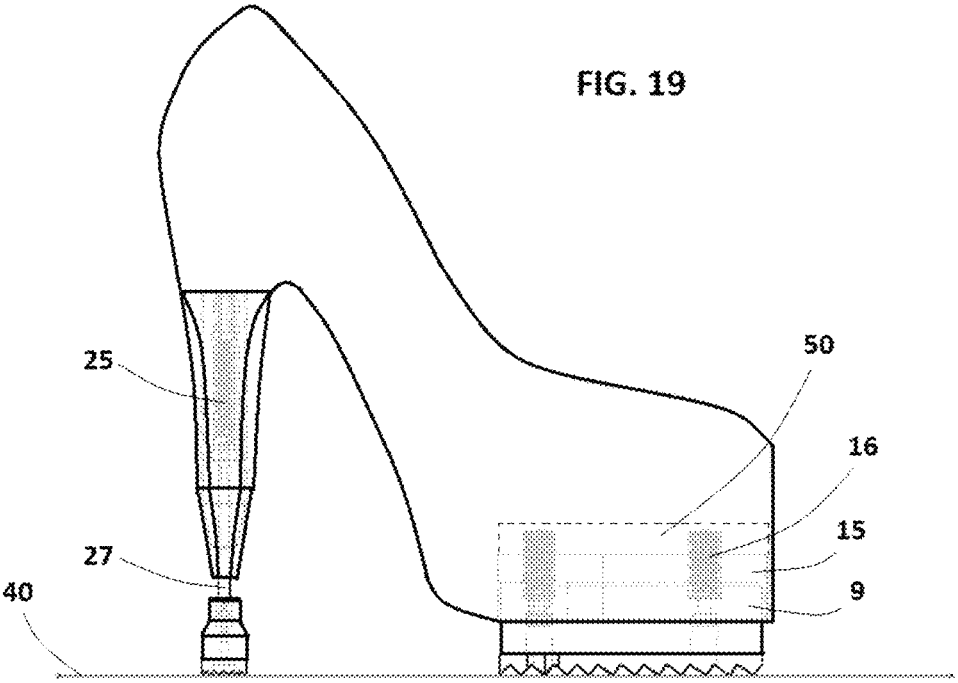
FIG. 19 Side view of a shoe in transparent format similar to FIG. 13, this embodiment detailing a self-contained front of the sole area compression system that resides in a recess cavity located in the sole, and the heel compression system detailing both systems in a non-compressed state.

FIG. 19 Transparent side view of a high heel style shoe with the compression system in its relaxed expanded state. The compression springs 25 and 16 are at their full length.

Figure 20:
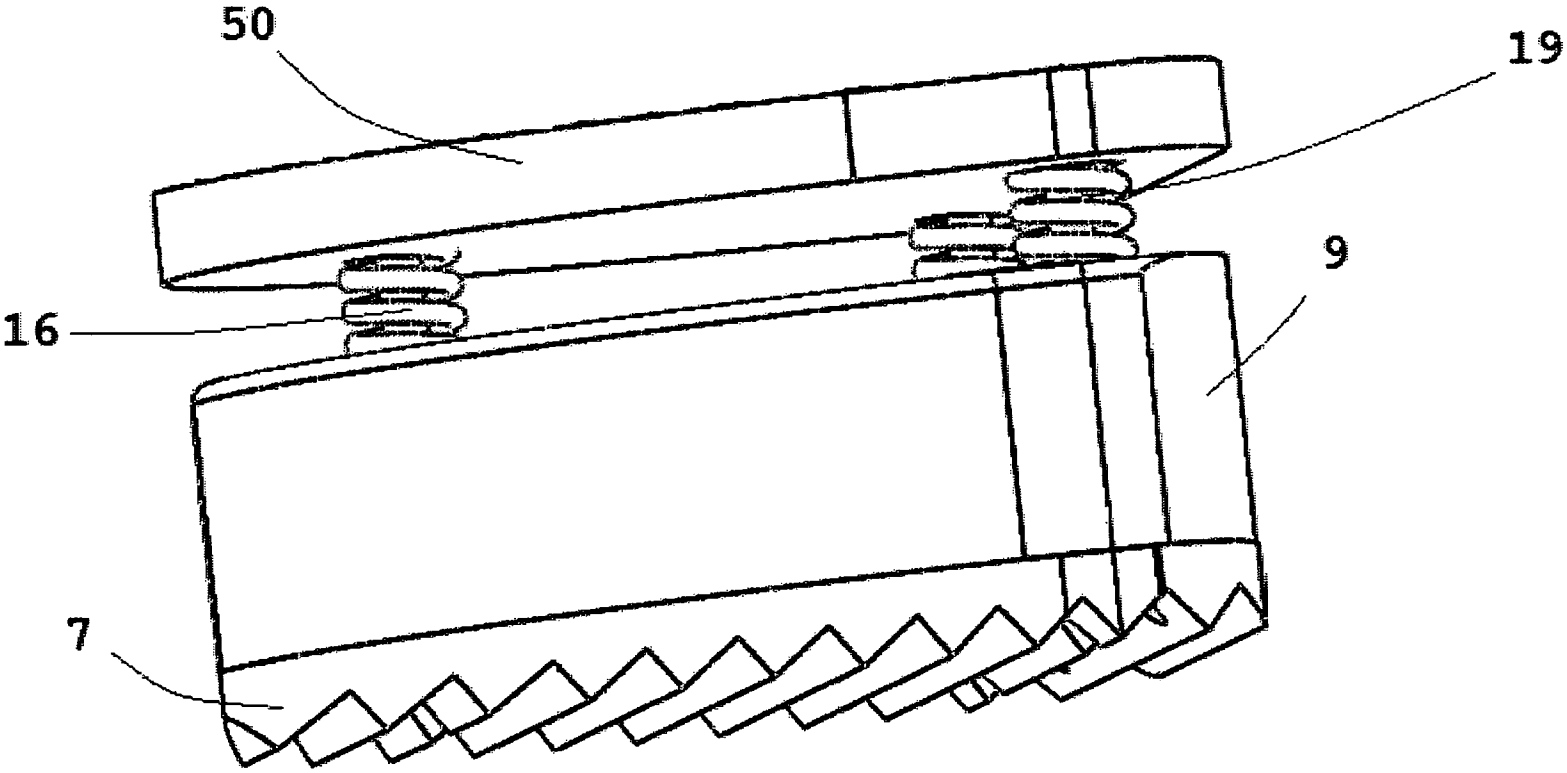
FIG. 20 In tipped side view detailing the self-contained front moveable inner sole compression system.

FIG. 20 Angled side view of the self contained front moveable inner sole compression system and detailing the base mounting plate 50, the springs 16, spring perch 19, front moveable inner sole component 9, and the front contact pad 7.

Figure 21:
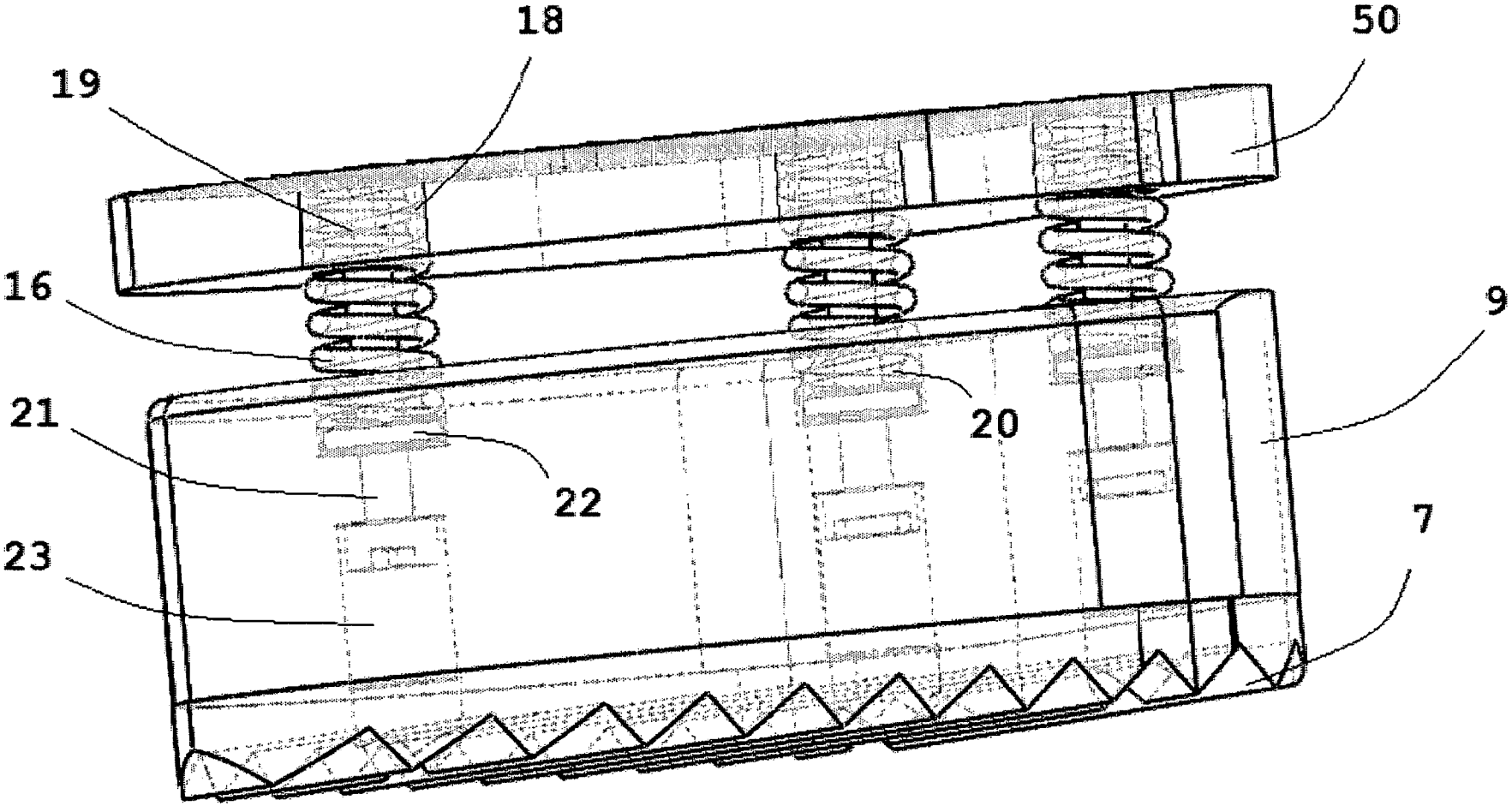
FIG. 21 In tipped side view and transparent detailing the self-contained front moveable inner sole compression system.

FIG. 21 Angled side view of the self contained front moveable inner sole compression system in transparency and detailing the base mounting plate 50 (which attaches into the recess 15 of the sole 3 (FIG. 2 #3A for sole thickness) (FIGS. 4, 11, 12, for sole callout)) one end of springs 16 mounted into the recess 18 within the base mounting plate 50 on spring perch 19, the other end of springs 16 attached in recess 20 of front moveable inner sole component 9 and contacting spring spacer contact 22 of the tension adjustment screw 21 which is accessible through access relief 23, also shown is front contact pad 7.

The embodiments described herein represent various aspects of the invention, but structural changes may be made so as to provide a shoe still falling within the scope of the invention.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A high heel style shoe comprising; an upper member, a sole, a front end toe portion, a heel portion, and an inner space configured for receiving a foot, an attachment point near the lower end of the heel portion, the attachment point for pivotally mounting a heel foot component, the attachment being on a horizontal axis, the horizontal axis being perpendicular to the length of the shoe, a tension blade with one end being securely mounted within the heel foot component, the other end of the tension blade being securely mounted within the lower end of the heel portion below the pivot attachment point, the tension blade restricting the ease of pivotal movement of the heel foot component, a rear edge of a foot pad of the heel foot component contacting the ground induces the heel foot component to pivot bringing the entire heel foot component foot pad in contact with the ground before the entire shoe makes contact with the ground creating a larger and more stable contact patch between the heel foot component foot pad and the ground, the tension blade always returning the heel foot component to an original position.

2. A high heel style shoe comprising; an upper member, a sole, a front end toe portion, a heel portion, and an inner space configured for receiving a foot, the heel portion having an internal pocket, an access portal from the heel portion internal pocket to the inner space configured for receiving a foot, the access portal being smaller in diameter than the internal pocket, a through hole from the bottom surface of the heel portion into the heel portion internal pocket, the through hole being smaller in diameter than the internal pocket;

the heel portion internal pocket configured to contain a compression cylinder housing, the compression cylinder housing having an internal cavity containing a compression spring, an adjustment screw, and a compression post, an end of the compression spring contacting a shoulder of the adjustment screw, another end of the compression spring contacting a shoulder of the compression post, the compression post also having a non-shouldered end extending from inside the compression cylinder housing internal cavity through the through hole at the bottom surface of the heel portion and having a pivot pin hole near the end of the compression post and a mounting slot below the pivot pin hole, a heel foot component having a pivot pin hole and a mounting slot, the bottom portion of the heel foot component having a foot pad for contact with the ground, a pivot pin for attaching the heel foot component to the compression post, a tension blade mounted between the compression post mounting slot and the heel foot component mounting slot, the tension blade offering significant resistance to allowing the heel foot component to pivot with ease requiring downward pressure to be applied by a wearer for the pivot to occur, the pivot of the heel foot component places the entire foot pad surface of the heel foot component in contact with the ground before the entire shoe contacts the ground, creating a larger and more stable contact patch between the foot pad and the ground, the tension blade returning the heel foot component to an original position when pressure is removed.

3. A high heel style shoe comprising; an upper member, a sole, a front end toe portion, a heel portion, and an inner space configured for receiving a foot;

an internal cavity in the front end toe portion of the sole, the internal cavity open from the bottom of the sole housing a self-contained compression system, the self-contained compression system including; a base mounting plate, a front moveable inner sole component, a plurality of springs, a plurality of tension adjustment screws, and a front contact pad, the springs compress to absorb the impact from the weight of a user generated during the walking process, the springs, having one end mounted on a spring perch located on the base mounting plate, the other end of the springs being attached to the front moveable inner sole component, the tension adjustment screws determining the tension of the springs by adjusting the range of compression, the adjustment screws are accessible through access holes in the bottom of the front contact pad and moveable inner sole component.

4. A shoe as claimed in claim 3 having a plurality of fully adjustable suspension systems in the sole of the shoe allowing for adjustable levels of absorption of ground contacting impact.

5. A high heel style shoe comprising; an upper member, a sole, a front end toe portion, a heel portion, and an inner space configured for receiving a foot, an internal pocket in the front end toe portion of the sole, an internal pocket in the heel portion, and a heel foot component;

an internal cavity in the front end toe portion of the sole, the internal cavity open from the bottom of the sole for housing a self-contained compression system, the self-contained compression system including; a base mounting plate, a front moveable inner sole component, a plurality of springs, a plurality of tension adjustment screws, and a front contact pad, the springs absorb impact under compression from the weight of a user distributed during the walking process, one end of springs mounted on a spring perch located on base mounting plate, the other end of the springs attached to the front moveable inner sole component, the tension adjustment screws determining the tension of the springs by adjusting the range of compression, the adjustment screws are accessible through access holes in the bottom of the front moveable inner sole component, the internal pocket of the heel portion having an access portal from the internal pocket to the inner space configured for receiving a foot, and being smaller in diameter than the internal pocket of the heel portion, a through hole from the bottom surface of the heel portion into the internal pocket of the heel portion and being smaller in diameter than the internal pocket;

the internal pocket of the heel portion configured to contain a compression cylinder housing, the compression cylinder housing having an internal cavity containing a compression spring, an adjustment screw, and a compression post, one end of the compression spring contacting a shoulder of the adjustment screw, the other end of the compression spring contacting a shoulder of the compression post, the compression post also having a non-shouldered end extending from inside the compression cylinder housing internal cavity through the through hole at the bottom surface of the heel portion and having a pivot pin hole and a mounting slot below the pivot pin hole, the heel foot component having a pivot pin hole, the bottom portion of the heel foot component having a foot pad for contacting the ground, a pivot pin for attaching the heel foot component to the compression post, a tension blade mounted between the compression post mounting slot and the heel foot component mounting slot, the tension blade offering significant resistance to allowing the heel foot component to pivot, requiring downward pressure to be applied by the user for the pivoting to occur, the pivoting places the entire foot pad surface of the foot component in contact with the ground before the entire shoe contacts the ground, creating a larger and more stable contact patch between the foot pad and the ground, the tension blade returning the heel foot component to an original position when pressure is removed.

* * * * *